US009145687B1

(12) United States Patent
Bancroft

(10) Patent No.: US 9,145,687 B1
(45) Date of Patent: Sep. 29, 2015

(54) CONVERTIBLE SUPPORT PAD APPARATUS

(71) Applicant: Russell N Bancroft, Simi Valley, CA (US)

(72) Inventor: Russell N Bancroft, Simi Valley, CA (US)

( * ) Notice: Subject to any disclaimer, the term of this patent is extended or adjusted under 35 U.S.C. 154(b) by 0 days.

(21) Appl. No.: 13/986,453

(22) Filed: May 7, 2013

Related U.S. Application Data

(63) Continuation-in-part of application No. 13/694,076, filed on Oct. 31, 2012, now abandoned.

(51) Int. Cl.

| | |
|---|---|
| ***E04D 13/12*** | (2006.01) |
| ***E04G 3/26*** | (2006.01) |
| ***E04D 15/00*** | (2006.01) |
| *B25H 1/12* | (2006.01) |
| *B25H 3/06* | (2006.01) |

(52) U.S. Cl.
CPC ..... *E04D 13/12* (2013.01); *E04D 15/00* (2013.01); *E04G 3/26* (2013.01); *B25H 1/12* (2013.01); *B25H 3/06* (2013.01)

(58) Field of Classification Search
CPC ..... E06C 1/345; E04D 13/12; E04D 15/00; B25H 1/12; B25H 3/06; E04G 3/26
See application file for complete search history.

(56) References Cited

U.S. PATENT DOCUMENTS

| | | | | | |
|---|---|---|---|---|---|
| 606,100 | A | * | 6/1898 | Thompson | 220/23.88 |
| 1,478,682 | A | * | 12/1923 | Stansberry | 182/45 |
| 2,708,543 | A | * | 5/1955 | Matich | 182/196 |
| 4,230,202 | A | * | 10/1980 | Kudra, III | 182/45 |
| 4,987,720 | A | * | 1/1991 | Wozney, Jr. | 52/749.12 |
| 5,119,904 | A | * | 6/1992 | Dierolf | 182/230 |
| 5,232,187 | A | * | 8/1993 | O'Farrell et al. | 248/148 |
| 5,249,397 | A | * | 10/1993 | Monaco | 52/126.1 |
| 5,546,671 | A | * | 8/1996 | Kehoe | 33/648 |
| 5,570,864 | A | * | 11/1996 | Flores | 248/148 |
| 5,609,322 | A | * | 3/1997 | Bond | 248/558 |
| 5,624,006 | A | * | 4/1997 | Richardson, Jr. | 182/45 |
| 5,887,406 | A | * | 3/1999 | Bond | 52/749.12 |
| 6,092,624 | A | * | 7/2000 | Slater | 182/45 |
| 6,343,439 | B1 | * | 2/2002 | Rutledge | 52/27 |
| 6,490,842 | B2 | | 12/2002 | Emmons | |
| 6,533,227 | B1 | * | 3/2003 | Rom | 248/148 |
| 6,732,480 | B1 | * | 5/2004 | Smith et al. | 52/126.1 |
| 7,950,620 | B2 | * | 5/2011 | Knight | 248/676 |

(Continued)

FOREIGN PATENT DOCUMENTS

| | | | | | |
|---|---|---|---|---|---|
| GB | 2131475 | A | * | 6/1984 | E04G 5/08 |

*Primary Examiner* — Colleen M Chavchavadze
(74) *Attorney, Agent, or Firm* — Larry F. Gitlin; Beaumont Gitlin Tashjian

(57) ABSTRACT

An improved support pad apparatus for distribution of weight loads and enabling the worker greater stability and balanced footing upon an underlying generally level or sloped surface includes a base platform having a top surface and a bottom surface, and one or more cleat members attached to or integrally formed within the top surface, and one or more cross members disposed in spaced relation across and formed integrally within or attached to the top surface. Also provided are riser members detachably connected to and conforming to the shape of the cross members to give additional height and surface area to the sides of the cross members to enable improved and more stable footing for the worker. A resilient pad is attached to the bottom surface for conforming to the contours of the underlying surface and distributing weight loads. A cover platform with reinforcing support rib members is provided for overlaying the base platform to convert the base platform for use on level underlying surfaces.

2 Claims, 21 Drawing Sheets

(56) References Cited

U.S. PATENT DOCUMENTS

| | | | | |
|---|---|---|---|---|
| 8,104,575 | B1 | 1/2012 | Bancroft | |
| 8,371,076 | B2 * | 2/2013 | Jones et al. | 52/173.3 |
| 8,960,620 | B1 * | 2/2015 | Merideth | 248/237 |
| 2002/0027091 | A1 * | 3/2002 | Brown | 206/372 |
| 2002/0046543 | A1 * | 4/2002 | Neuleib | 52/749.12 |
| 2003/0037990 | A1 | 2/2003 | Testa | |
| 2005/0223660 | A1 * | 10/2005 | Henning et al. | 52/203 |
| 2006/0226310 | A1 * | 10/2006 | Hall et al. | 248/148 |
| 2006/0277863 | A1 * | 12/2006 | Henning et al. | 52/749.12 |
| 2014/0209411 | A1 * | 7/2014 | McCarthy et al. | 182/129 |

* cited by examiner

CONVERTIBLE SUPPORT PAD APPARATUS

This is a continuation-in-part of application Ser. No. 13/694,076 filed Oct. 23, 2012, now abandoned.

BACKGROUND OF THE INVENTION

1. Field of the Invention

The present invention relates generally to the building construction and related trades and, more particularly, to an improved convertible support pad apparatus for ensuring the proper and safe distribution of weight loads and stable footing upon an underlying generally level or sloped working surface.

2. Description of the Prior Art

In the building construction and related trades, it is important to provide the means for the construction worker to work safely and efficiently upon underlying sloped or generally level surfaces, such as, for example, inclined and flat roofs, and all types of terrain.

As disclosed in U.S. Pat. No. 8,104,575 B1 issued Jan. 31, 2012, to Bancroft, a support pad apparatus is provided for ensuring the proper distribution of weight loads comprising, for example, the gross weight of the construction worker, the worker's tools and/or equipment and construction materials, and stable and secure footing on a variety of surfaces, though usually while the worker is operating on moderately inclined and especially heavily sloped roof surfaces.

In the prior art, in addition to Bancroft, is U.S. Pat. No. 6,490,842 B2 issued Dec. 10, 2002 to Emmons, which is directed to a traction pad for use in roof-related repairs of a sloped roof. The device includes a traction pad for maneuvering on a roof and contains a base layer, a traction layer, and at least two traction cross members and two end members. The base and traction layers are preferably rectangular in shape. The bottom surface of the base layer engages the roof surface, with the traction layer attached to the top surface. At least two traction cross members are attached to the top surface across its length. The two end members are attached adjacent the ends of the two traction cross members. The top surface of the traction layer is typically covered with a paint containing sand to provide improved traction.

The Emmons invention has several drawbacks, as follows: the cross members, because their configuration is triangular, and more particularly because the shape of the apex of the triangle is too sharp, do not provide reliable footing when the traction pad is disposed upon underlying steep surfaces. Thus, the cross members are unsafe. Further, workers will most certainly find it uncomfortable and even painful to kneel down or sit upon the traction pad, particularly the apex of the cross members, when circumstances may require or compel them to do so. Also, the handle openings projecting from the top sides of the two end members, because they present a risk to the worker, who might trip or stumble over them, are inherently hazardous. The Emmons invention is also a relatively complicated apparatus requiring the assembly of at least seven separate components and twenty-five to thirty screws and bolts to secure all the connections.

Also a part of the prior art is U.S. App. Publication No. 2003/0037990 A1 directed to a pad providing protection, safety and stabilization to a worker on a sloped surface, which has the added benefit of protecting the sloped surface itself. The pad is flexible to effectively grip or attach itself to a sloped surface, and contains a multitude of indentations or footholds on the upper surface for engagement of the worker's shoes to provide stability.

The disadvantages of the prior art devices are numerous, as follows: none have the significant structural reinforcement that is embodied in the improved support pad apparatus of the present invention; and, none embodies the convertible or the several other important novel features of the present invention, all of which contribute to the improvement of the construction worker's footing and balance, when working on a variety of underlying surfaces. These include conventional sloped roofs, level surfaces or terrain, such as a flat roof, or surfaces consisting of exterior hardscape, sloped or level. Not until the conception and reduction to practice of the improved support pad apparatus herein has a device addressed these and so many other significant shortcomings prevalent in the prior art.

SUMMARY OF THE INVENTION

The preferred embodiment of the present invention provides an improved support pad apparatus for distribution of weight loads and enabling workers greater stability and balanced footing when walking upon an underlying generally level or sloped surface. The improved support pad apparatus includes a base platform having a first side and a second side, a front end with a front side and a back end with a back side, a top surface and a bottom surface, one or more cleat members attached to or integrally formed within the top surface, and one or more cross members disposed in parallel relation across and formed integrally within or attached to the top surface. Each cross member includes a top section with a top surface, and first and second sidewalls with each of the sidewalls having a bottom portion running along its entire length. The cleat members and the cross members combine to provide support to the construction worker's footing to compensate for any difficult angle of inclination formed by the underlying surface, typically a sloped roof, and to enable the oblique orientation of the person's generally upstanding body relative to the angle of inclination to ensure proper balance and greater safety on the job.

Also provided are one or more riser members detachably connected to the area of the base platform immediately adjacent to the bottom portion of the sidewalls of each cross member. Each riser member, which conforms generally to the shape of the cross member, gives the cross member additional height and surface area to enable improved and more stable and secure footing for the worker when working conditions require it. Each riser member has a top surface and a first and a second sidewall with each sidewall having a bottom edge. Additionally provided is a resilient pad, generally flat, or concave or convex in design, attached to the bottom surface of the base platform for substantially conforming to the shape and contours of the underlying surface and receiving and distributing a weight load over the top surface to protect the underlying surface from damage.

The preferred embodiment of the present invention also includes a cover platform, with one variant that covers only the cleat and cross members, but not the entire base platform framework, and a second variant that covers the entire base platform framework. The cover platform, in either variant, is provided primarily, though not exclusively, for placement upon the base platform in overlaying relation, as described, for converting the base platform for use on moderately sloped and substantially level underlying surfaces. The bottom surface of the cover platform, in either embodiment, includes a plurality of reinforcing support rib members to provide strength and rigidity to the cover platform. This enables the base and cover platforms, when joined, to be utilized on moderately sloped and generally level underlying surfaces, indoors and outdoors, and to more effectively accommodate and distribute increased weight loads, due to the enhanced strength of the combined platforms. Adjacent support rib members are disposed laterally in spaced parallel relation and also linearly in spaced relation forming slotted openings along a plane transverse to the axis of the linearly disposed support rib members for receiving the cross members in conformal relation. This enables a secure and stable connection between the base and cover platforms to ensure a strong rigid support structure. The support pad apparatus of the present invention also includes a leveling insert, a storage unit, and some additional modifications, as more particularly set forth and described below in the Detailed Description of the Preferred Embodiment.

Accordingly, it is an object of the present invention to provide a support pad apparatus that embodies the means for improved structural reinforcement when subjected to increased weight loads.

Another object of the present invention is to provide a support pad apparatus that employs the means to easily and quickly convert from a platform for use on sloped surfaces to a platform deployable on generally flat or level surfaces.

Still another object of the present invention is to provide a support pad apparatus with the means to convert to a hybrid platform to enable the construction worker to operate on both sloped and level platforms without the need to entirely convert to one or the other.

Still another object of the present invention is to provide a support pad apparatus with the means to accommodate compartments to hold or store equipment, tools and/or construction materials.

Still another object of the present invention is to provide a support pad apparatus that includes the means to improve the construction worker's footing and balance while operating on a sloped underlying surface, especially those that are steeply inclined.

Still another object of the present invention is to provide a support pad apparatus that is easy and cost effective to manufacture.

Still another object of the present invention is to provide a support pad apparatus that is relatively lightweight, and easy to transport, stack and store.

Other objects and advantages of the present invention will become apparent in the following specifications when considered in light of the attached drawings wherein the preferred and alternative embodiments of the invention are illustrated.

Figure 1:
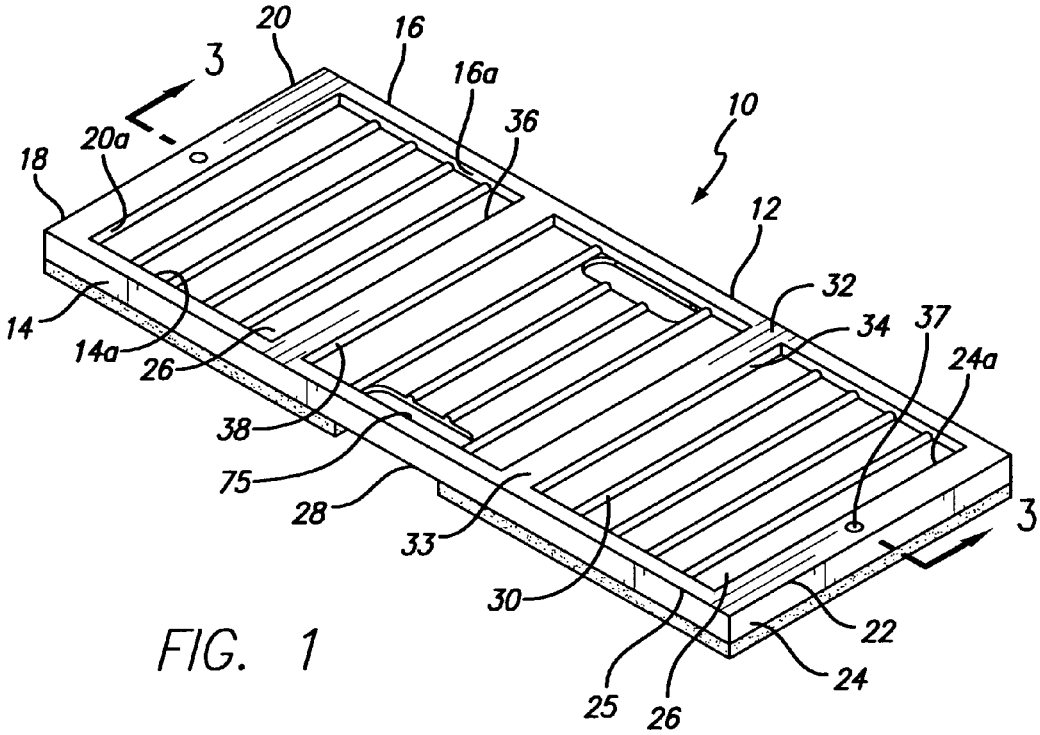
FIG. 1 is a perspective view of the base platform in accordance with the present invention.
Figure 2:
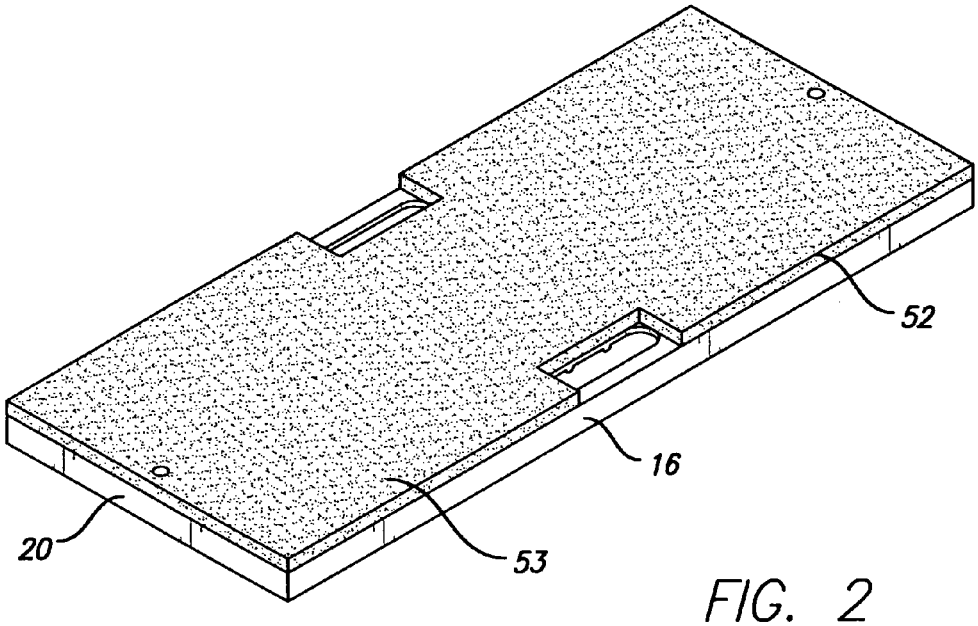
FIG. 2 is a perspective view of the resilient pad portion shown attached to the base platform in accordance with the present invention.
Figure 3:
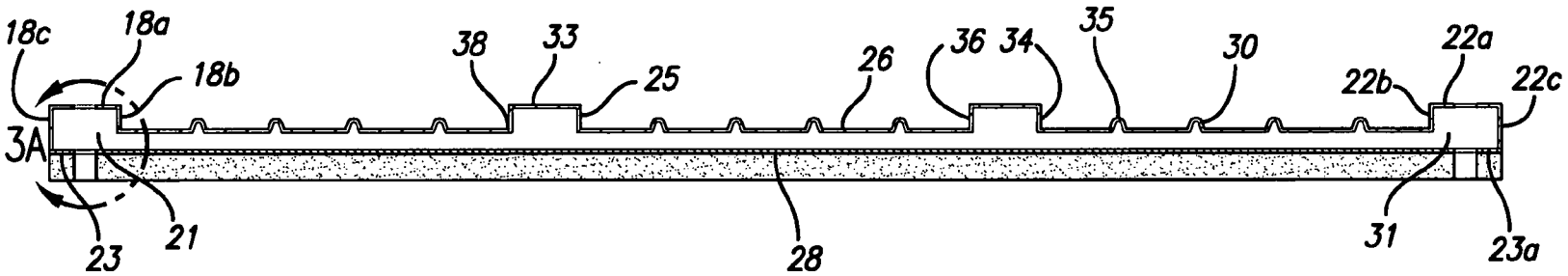
FIG. 3 is a cross-sectional view of the base platform and the attached resilient pad taken along lines 3-3 of FIG. 1 in accordance with the present invention.
Figure 3A:
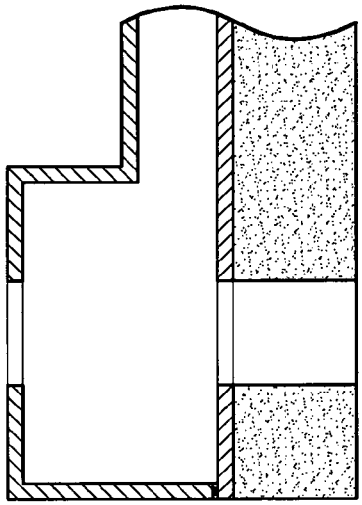
FIG. 3A is an enlarged perspective view of the base platform shown in cross-section in FIG. 3 in accordance with the present invention.

The features of this invention, which are believed to be novel, are set forth with particularity in the appended claims. The present invention, both as to its organization and manner of operation, together with further objects and advantages thereof, may be best understood by reference to the following detailed description, taken in conjunction with the accompanying drawings.

DETAILED DESCRIPTION OF THE PREFERRED AND ALTERNATIVE EMBODIMENTS

The improved support pad apparatus 10 of the present invention is employed principally for weight load distribution, normal and extraordinary, enabling construction worker 47 more stable footing and ensuring proper balance for construction worker 47 while operating upon an underlying generally level or sloped surface. Support pad apparatus 10 includes base platform 12 having first side 14 and interior wall 14*a*, second side 16 and interior wall 16*a*, front end 18 with front side 20 and interior wall 20*a*, and back end 22 with back side 24 and interior wall 24*a*. Front end 18 has a top section 18*a*, which is integrally formed with sidewalls 18*b* and 18*c*. Similarly, back end 22 has a top section 22*a*, which is integrally formed with sidewalls 22*b* and 22*c*. Top section 18*a*, together with integrally formed sidewalls 18*b*, 18*c* and top section 22*a*, together with integrally formed sidewalls 22*b* and 22*c*, each define corresponding hollow spaces 21 and 31 within, which extend the entire length of front end 18 and back end 22, respectively. Base platform 12 also includes top section 25 having top surface 26 and bottom section 27 having bottom surface 28, and one or more cleat members 30, which are generally triangular in shape, but usually with a blunted or rounded tip or apex 35 attached to or integrally formed within top surface 26. Also included are two or more cross members 32, generally rectangular in shape, although a variety of other geometric shapes may also be suitable, disposed in spaced relation across and formed integrally within or attached to top surface 26. Cleat members 30 may also be configured more rectangularly. Each cross member 32 includes top surface 33 with openings 37 formed at opposite ends to attach two or more base platforms 12 end to end, first sidewall 34 and second sidewall 36 with each sidewall 34, 36 having base portion 38 extending the length of the sidewall along its base. The typical dimensions of base platform 12 are 2' in width by 4' in length, and about 4" thick, although these dimensions may vary, including, without limitation, 3' to 6' in width by 3' to 8' in length, with a thickness ranging from 3" to 6". Base platform 12 may be fabricated by joining together certain combinations of the individual components of the platform (e.g. sides 14,16,20,24, and top surface 26, as one united component, with cleat members 30 and cross members 32 joining separately) using any suitable and conventional bonding means for this purpose. Top section 25 and bottom section 27 may also be fabricated as a single unit, integrally formed utilizing any appropriate molding process, or by combining top section 25 and bottom section 27 and securing them using any suitable bonding agent, such as, by way of example only, adhesive 29.

Under some circumstances, such as, for example, where top section 25 and bottom section 27 are separate components fused or bonded together adhesively or otherwise, portions 23 and 23*a* of bottom section 27 may tend to buckle or collapse into hollow spaces 21 and 31, respectively, where no reinforcement or resistance is provided. To avoid this situation, and give appropriate support for bottom section 27, one or more generally cup-shaped openings 39 are compressibly formed in top sections 18*a* and 22*a* of front end 18 and back end 22, respectively. Using an appropriate die to mold the material from which base platform 12 is produced, means are provided to compressibly form cup-shaped openings 39 in top sections 18*a* and 22*a*, forcing the material to compress downwardly almost to the point where top section 25 and bottom section 27 are joined. More particularly, the material comprising top section 18*a* and sidewalls 18*b* and 18*c*, and top section 22*a* and sidewalls 22*b* and 22*c*, are compressed under great pressure. The effect is a thickening and strengthening of sidewalls 18*b* and 18*c* and 22*b* and 22*c*, which become more rigid as a result. Additionally, the compressed material 49 formed at bottom 59 of cup-shaped openings 39, which are now thickened and more rigid, serves to provide the reinforcement means required to keep portions 23 and 23*a* from collapsing into the previously existing hollow spaces 21 and 31, respectively.

Cleat members 30 and cross members 32 are provided to give enhanced support to a person's footing to compensate for the angle of inclination formed by the underlying surface, for example, sloped roof 40, enabling the oblique orientation of the person's generally upstanding body relative to the angle of incline to ensure proper balance and a safer working condition.

Riser member 42, which conforms generally to the shape of each cross member 32, is disposed upon cross member 32 to give it additional height and surface area along its sidewalls. This enables construction worker 47 improved and significantly more reliable footing, particularly upon steeply inclined underlying surfaces. Riser member 42 includes a top section 43, with a top surface 45 and first side 44 and second side 46 with first side 44 including first bottom edge 48 and second side 46 including second bottom edge 50. Riser member 42 is typically 1½" in height, which adds approximately ½" to the height of cross member 32 which, in the preferred embodiment, by itself, is 1" in height. Depending upon a variety of factors, including, without limitation, the particular size requirements of the user, these dimensions may vary somewhat. To further secure riser member 42 to cross member 32, first side 44 and second side 46, respectively, are oriented slightly inward to form an acute interior angle of approximately 80°, though the slope of the angle may vary, at each vertex 41 where top section 43 joins first side 44 and second side 46 to ensure a relatively tight and secure friction fit for riser member 42 when it overlays cross member 32.

Disposed adjacent or in close proximity to one or more base portions 38 of corresponding sidewalls 34, 36 are one or more openings 54, and attached to or formed integrally with first bottom edge 48 and second bottom edge 50 of each riser member 42 are mating projecting pins 56 adapted to fit slidably into openings 54 in releasable engagement as an alternative for securing each riser member 42 to cross member 32. Openings 54 may also be slotted (not shown) to accommodate a projection means (also not shown), which, as with projecting pin 56, is attached to or formed integrally with bottom edges 48,50, and is shaped more like a "key", being configured flatter and wider than projecting pin 56 to better conform to the slot.

Resilient pad 52, which includes an underside 53 having a generally flat, convex or concave configuration and/or embodying some sort of textured, uneven, or crater-like surface, is comprised of a conformable material, such as polyethylene foam or rubber, and is attached to bottom surface 28 using any suitable attachment means for this purpose, such as, for example, strong adhesive. Resilient pad 52 is provided for substantially conforming to the shape and contours of the underlying surface, whether the surface is sloped or generally level, or exists within, on top of or outside of a building, or any other type of structure. Base platform 12 combines with resilient pad 52 to receive and distribute weight loads over top surface 26 to protect against damage to the underlying surface and to provide a frictional base to hold support pad 10 securely to the underlying surface.

Figure 15:
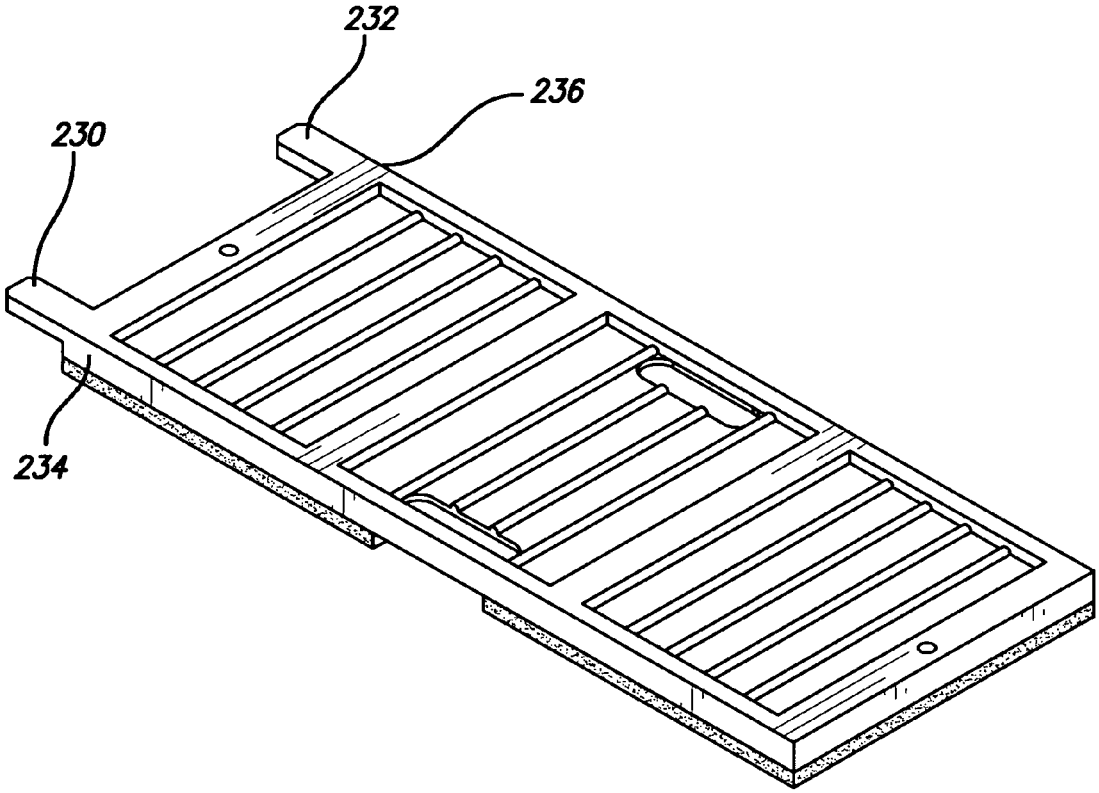
FIG. 15 is a perspective view of the base platform with laterally spaced apart arms projecting outwardly from either end in accordance with the present invention.
Figure 16:
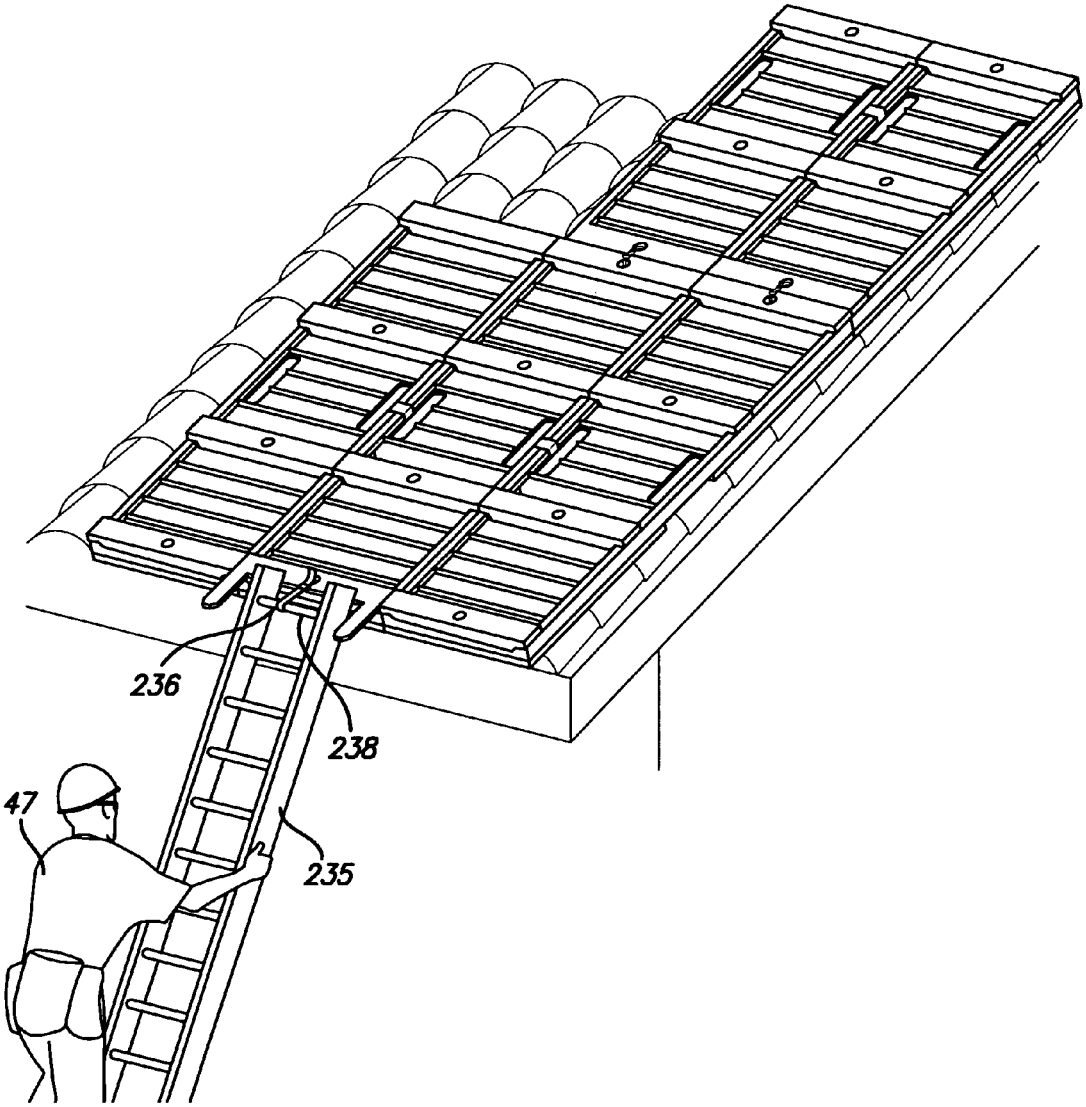
FIG. 16 is a perspective view of the support pad with projecting arms formed along one end situated on a sloped roof surface and a ladder leaning against the support pad between the projecting arms in accordance with the present invention.
Figure 17A:
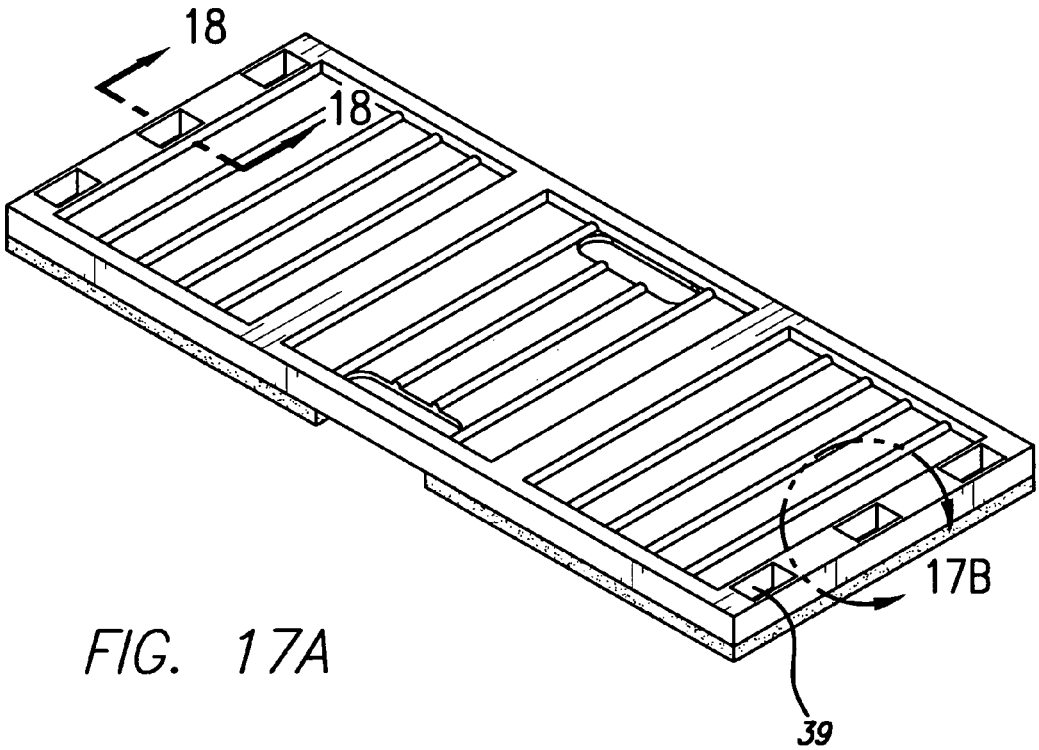
FIG. 17A is a perspective view of the base platform shown with each end modified to provide additional support for the base platform's bottom section in accordance with the present invention.
Figure 17B:
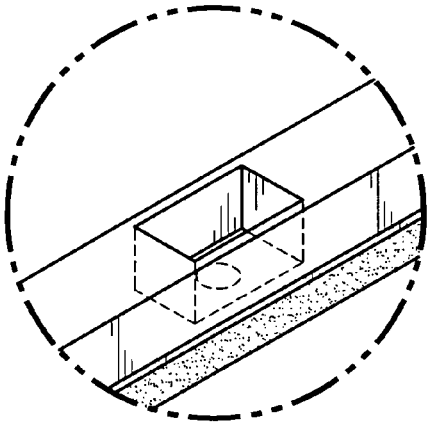
FIG. 17B is an enlarged view of a portion of one end of the base platform shown in FIG. 17A defined by circular line 17B in FIG. 17A in accordance with the present invention.
Figure 18:
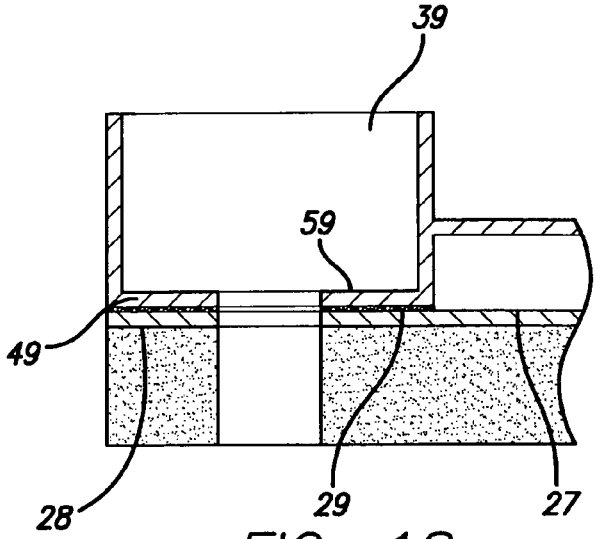
FIG. 18 is a cross-sectional view of one end of the base platform shown in FIG. 17A taken along lines 18-18 of FIG. 17A in accordance with the present invention.

An alternative embodiment of base platform 12 is shown in FIG. 15, and comprises base platform 12 with laterally spaced apart forwardly projecting arms 230 and 232 extending outwardly from left side 234 and right side 236 of front end 18 forming a U-shaped configuration. In its typical application, projecting arms 230 and 232 are integrally formed with front end 18, although retrofitted versions of arms 230 and 232 may be appropriate in some circumstances. Projecting arms 230 and 232 are utilized for containing there between ladder 235 to restrict the lateral movement of ladder 235 and ensure that ladder 235 is held securely in place and provides a safe and stable means for construction worker 47 to access sloped roof 40. Ladder 235 may be further secured by joining it with support pad 12 utilizing rope 236 or any other suitable device, threading rope 236 through opening 37 and around ladder rung 238, and then attaching the two, as shown in FIG. 16.

Figure 4A:
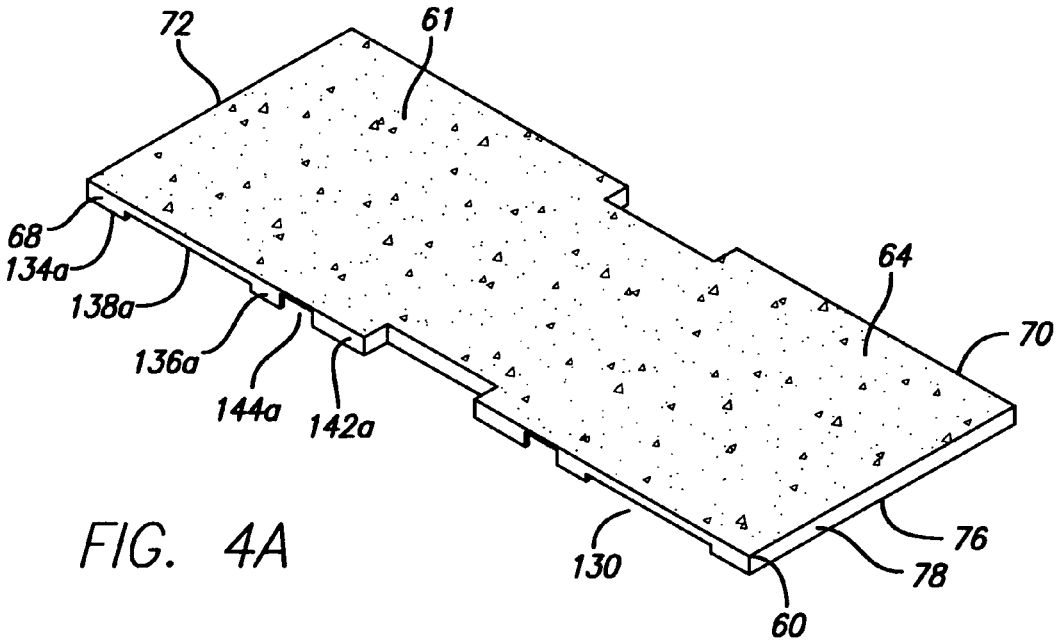
FIG. 4A is a perspective view of one variant of the cover platform in accordance with the present invention.
Figure 4B:
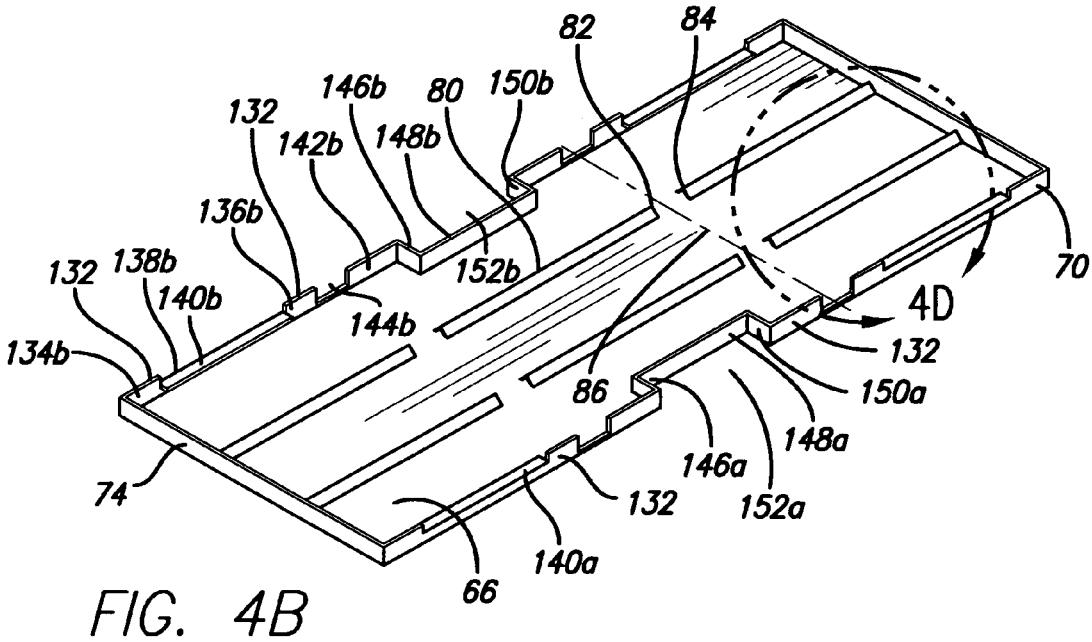
FIG. 4B is a perspective view of the bottom surface of the cover platform shown in FIG. 4A in accordance with the present invention.
Figure 4C:
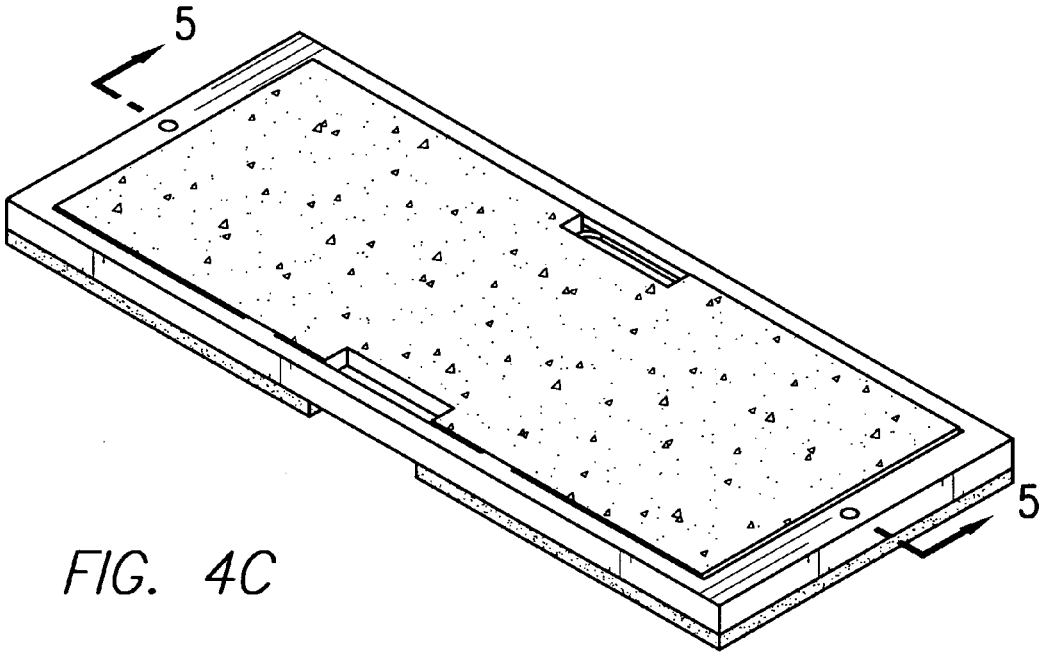
FIG. 4C is a perspective view of the cover platform shown in FIG. 4A overlaying the base platform in accordance with the present invention.
Figure 4D:
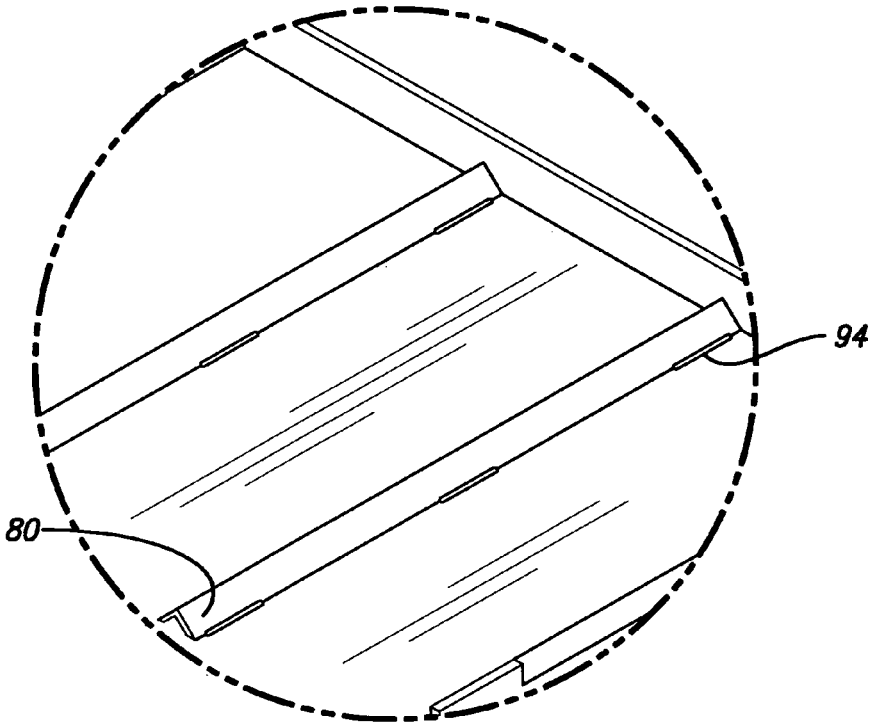
FIG. 4D is an enlarged perspective view of a section of the bottom surface of the cover platform shown in FIG. 4A in accordance with the present invention.
Figure 5:
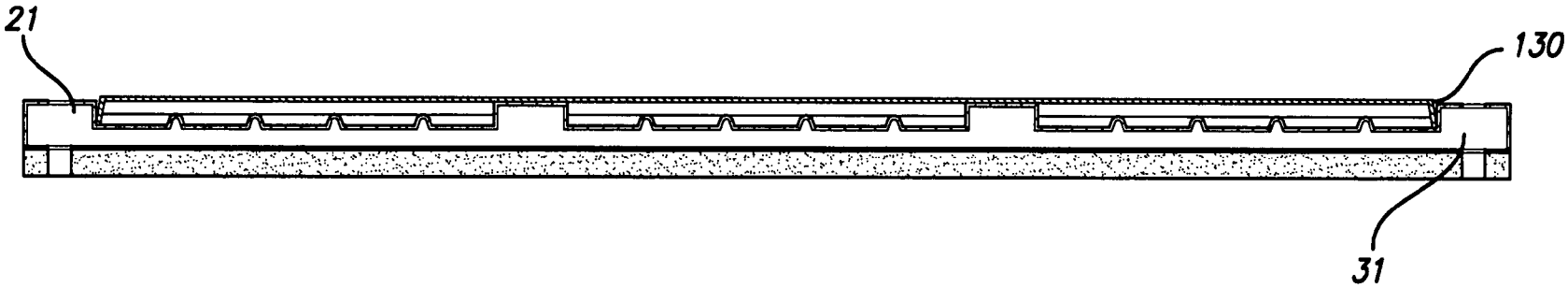
FIG. 5 is a cross-sectional view of the cover platform shown in FIG. 4A overlaying the base platform taken along lines 5-5 of FIG. 4C in accordance with the present invention.
Figure 6:
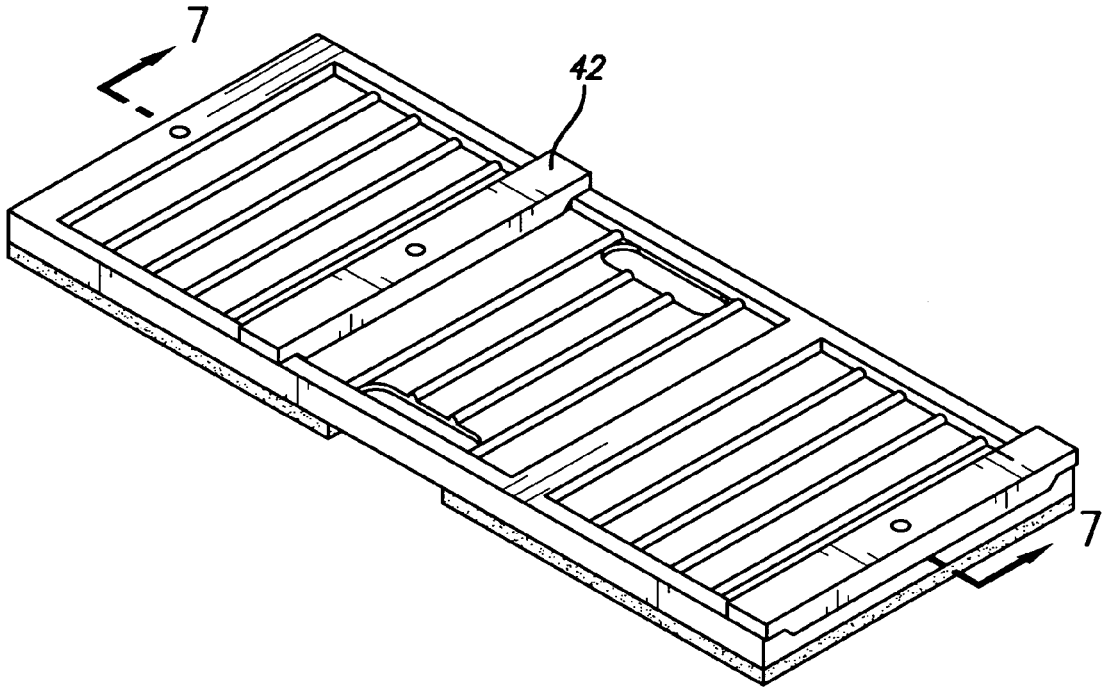
FIG. 6 is a perspective view of riser members overlaying cross members in accordance with the present invention.
Figure 6A:
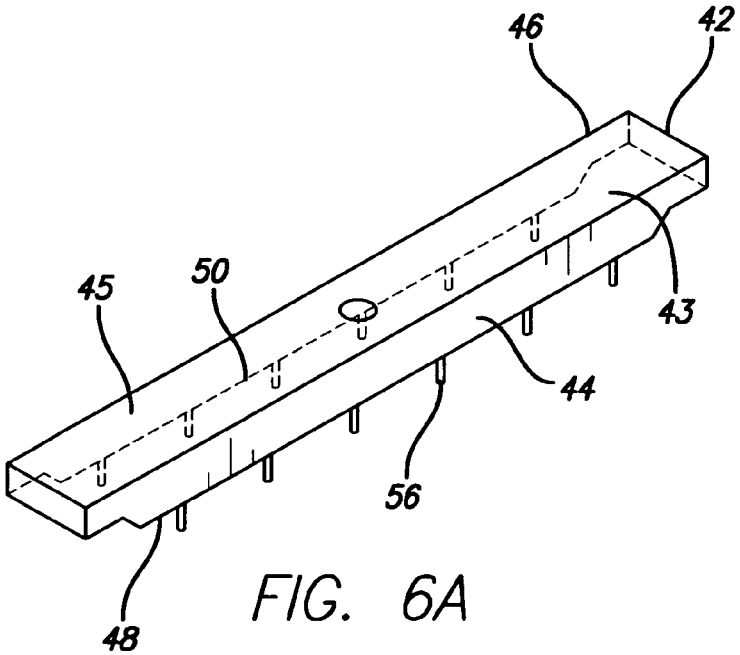
FIG. 6A is a perspective view of an individual riser member in accordance with the present invention.
Figure 6B:
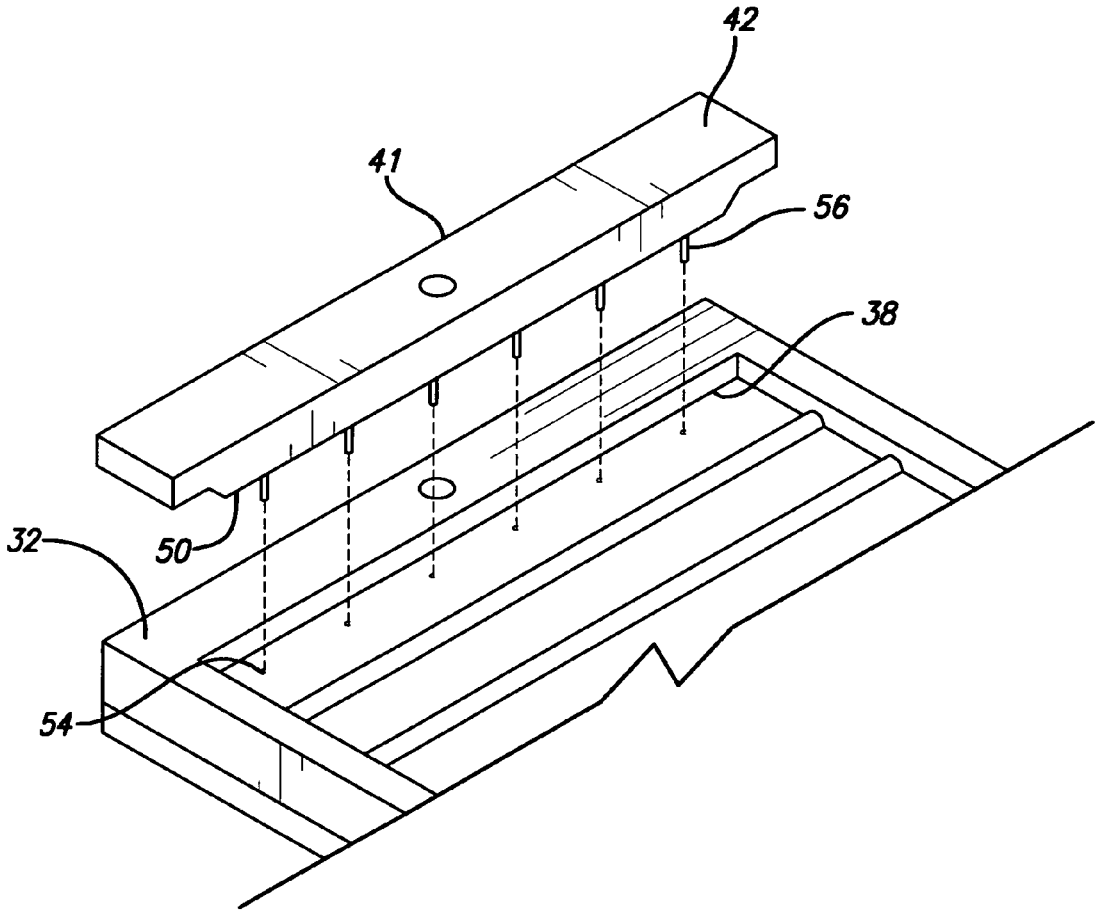
FIG. 6B is an enlarged perspective view of a section of the base platform showing a riser member in the process of overlaying a cross member in accordance with the present invention.
Figure 7:
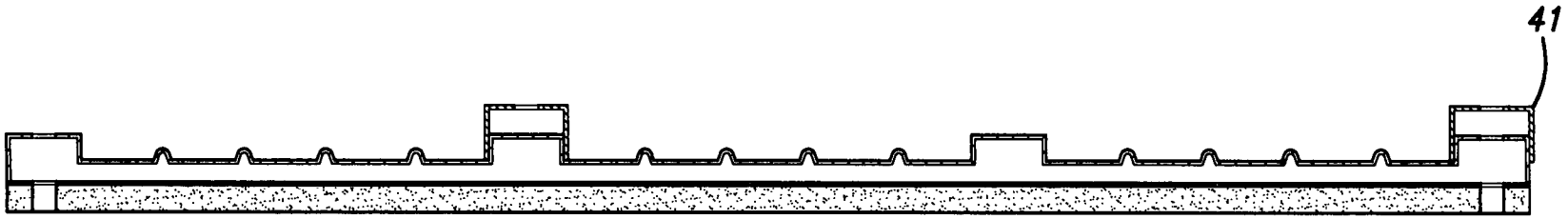
FIG. 7 is a cross-sectional view of riser members overlaying cross members of the base platform taken along lines 7-7 of FIG. 6 in accordance with the present invention.
Figure 8A:
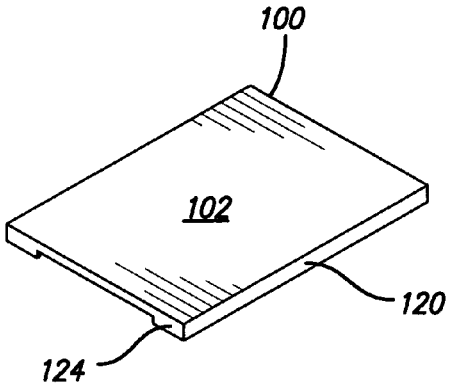
FIG. 8A is a perspective view of the top surface of a leveling insert in accordance with the present invention.
Figure 8B:
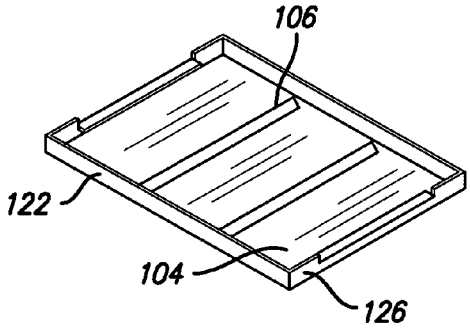
FIG. 8B is a perspective view of the bottom surface of a leveling insert in accordance with the present invention.
Figure 8C:
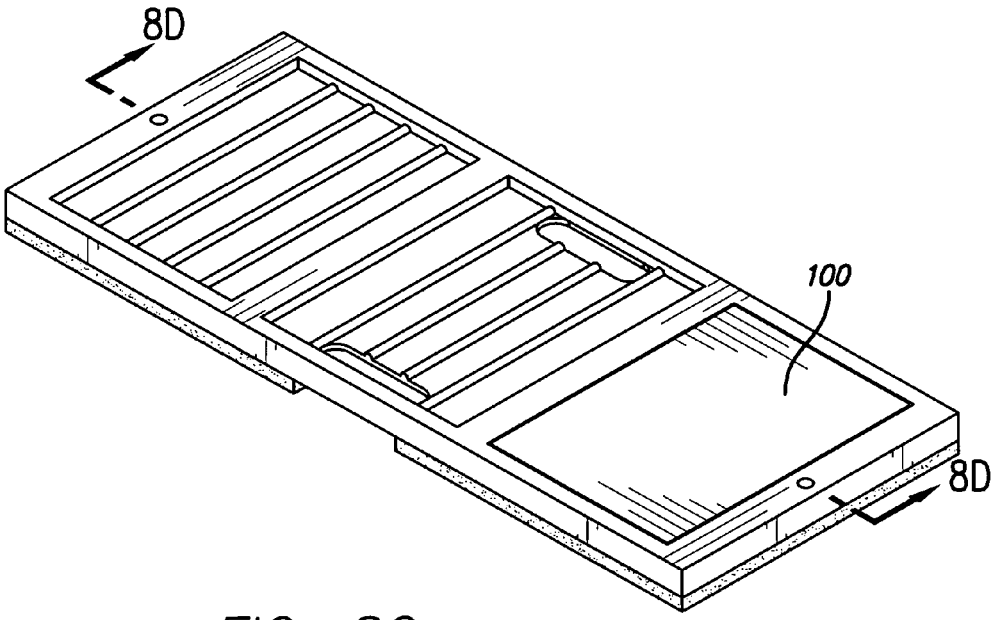
FIG. 8C is a perspective view of the base platform incorporating a leveling insert in accordance with the present invention.
Figure 8D:
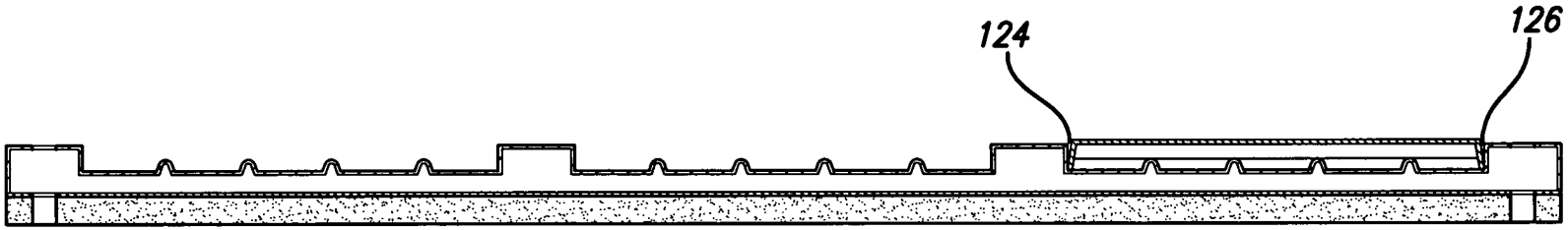
FIG. 8D is a cross-sectional view of the base platform incorporating a leveling insert taken along lines 8D-8D of FIG. 8C in accordance with the present invention.
Figure 9A:
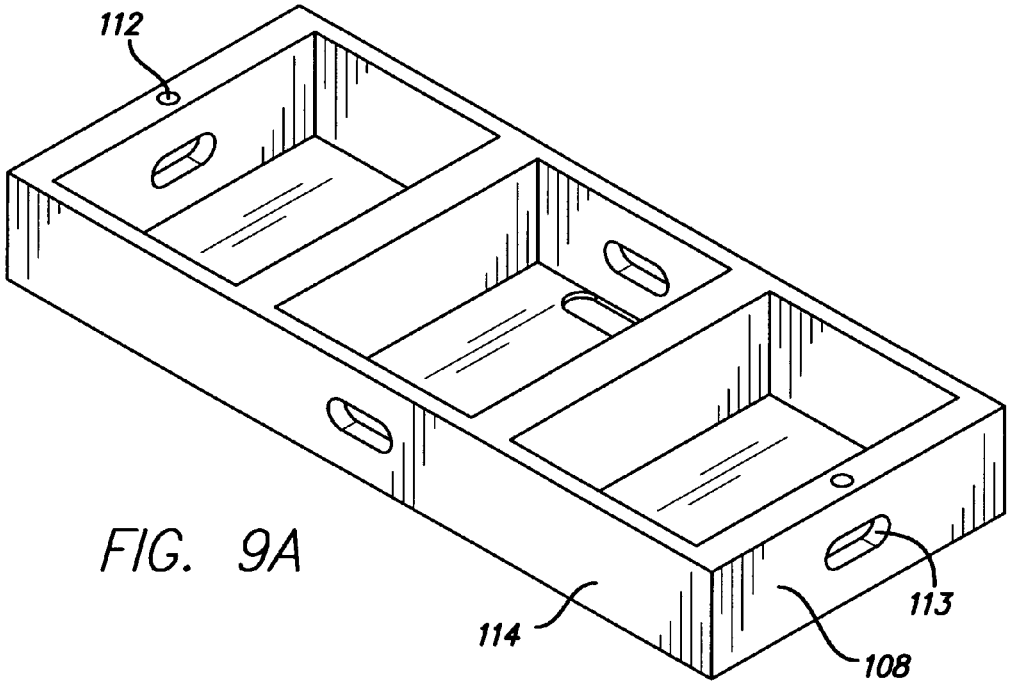
FIG. 9A is a perspective view of a storage container unit in accordance with the present invention.
Figure 9B:
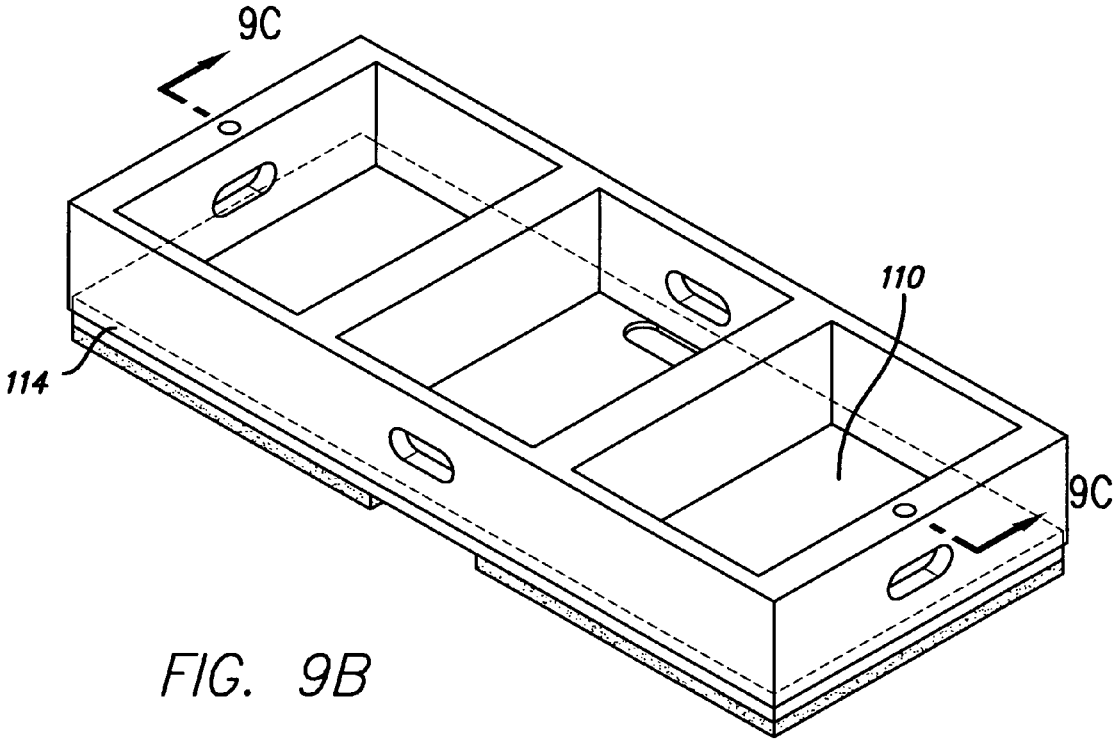
FIG. 9B is a perspective view of the base platform with an overlaying storage container unit in accordance with the present invention.
Figure 9C:
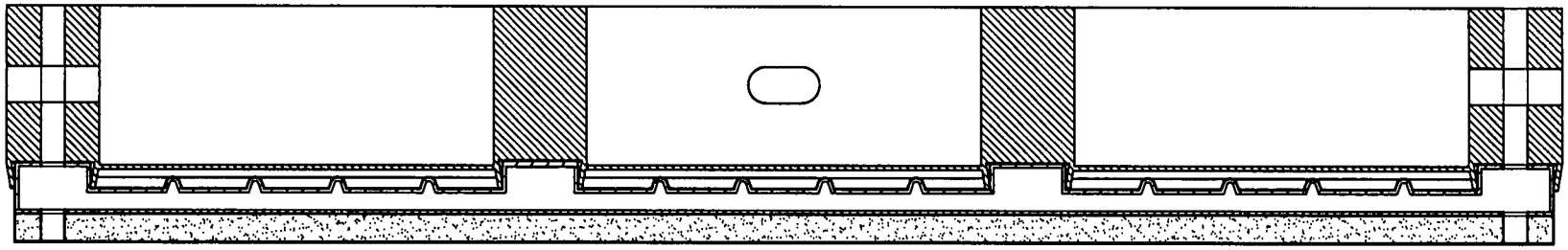
FIG. 9C is a cross-sectional view of the base platform with an overlaying storage container unit taken along lines 9C-9C of FIG. 9B in accordance with the present invention.
Figure 10:
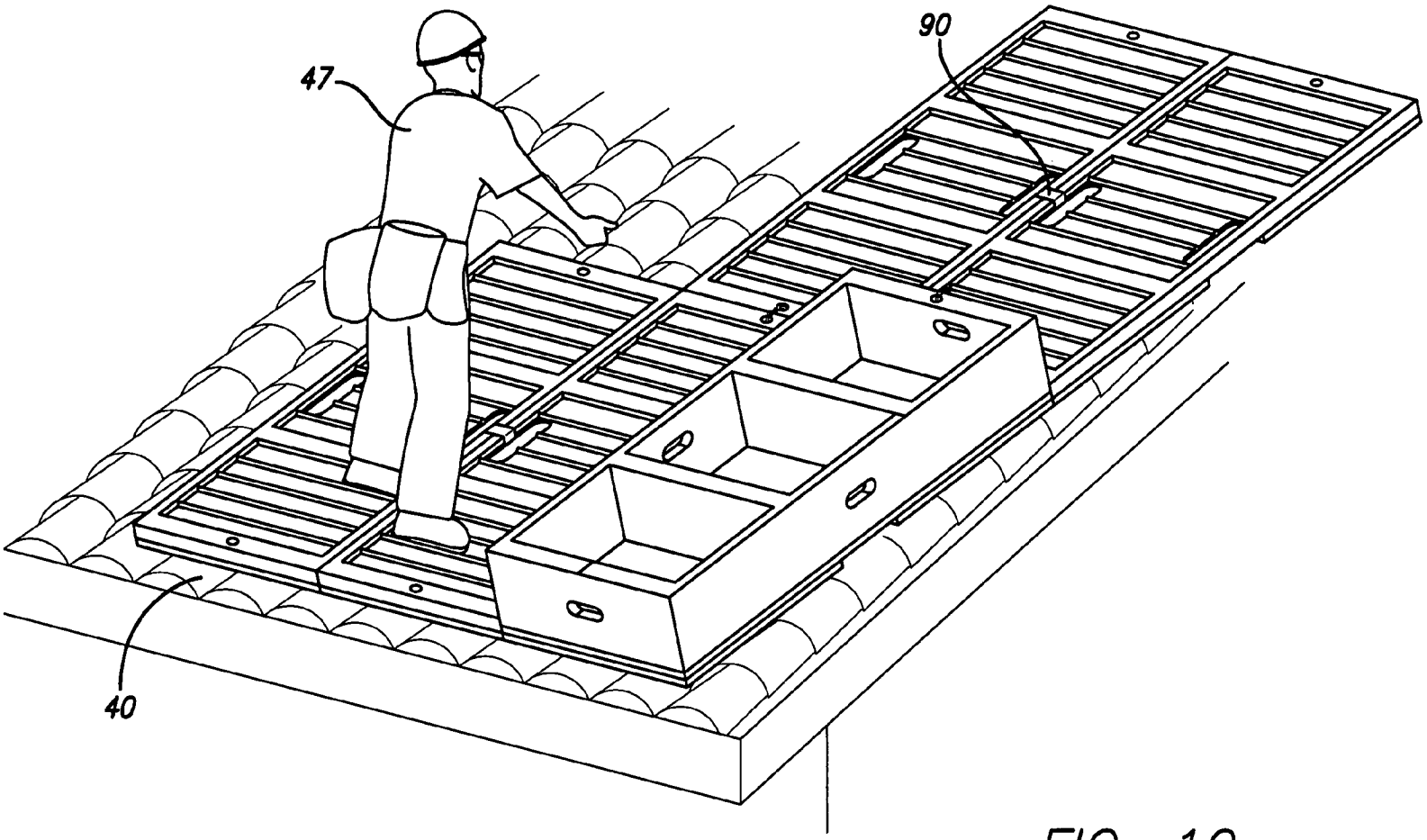
FIG. 10 is a perspective view of the preferred embodiment of the support pad apparatus in accordance with the present invention, including the storage container unit, shown in use by a construction worker operating on an underlying sloped roof surface.
Figure 11:
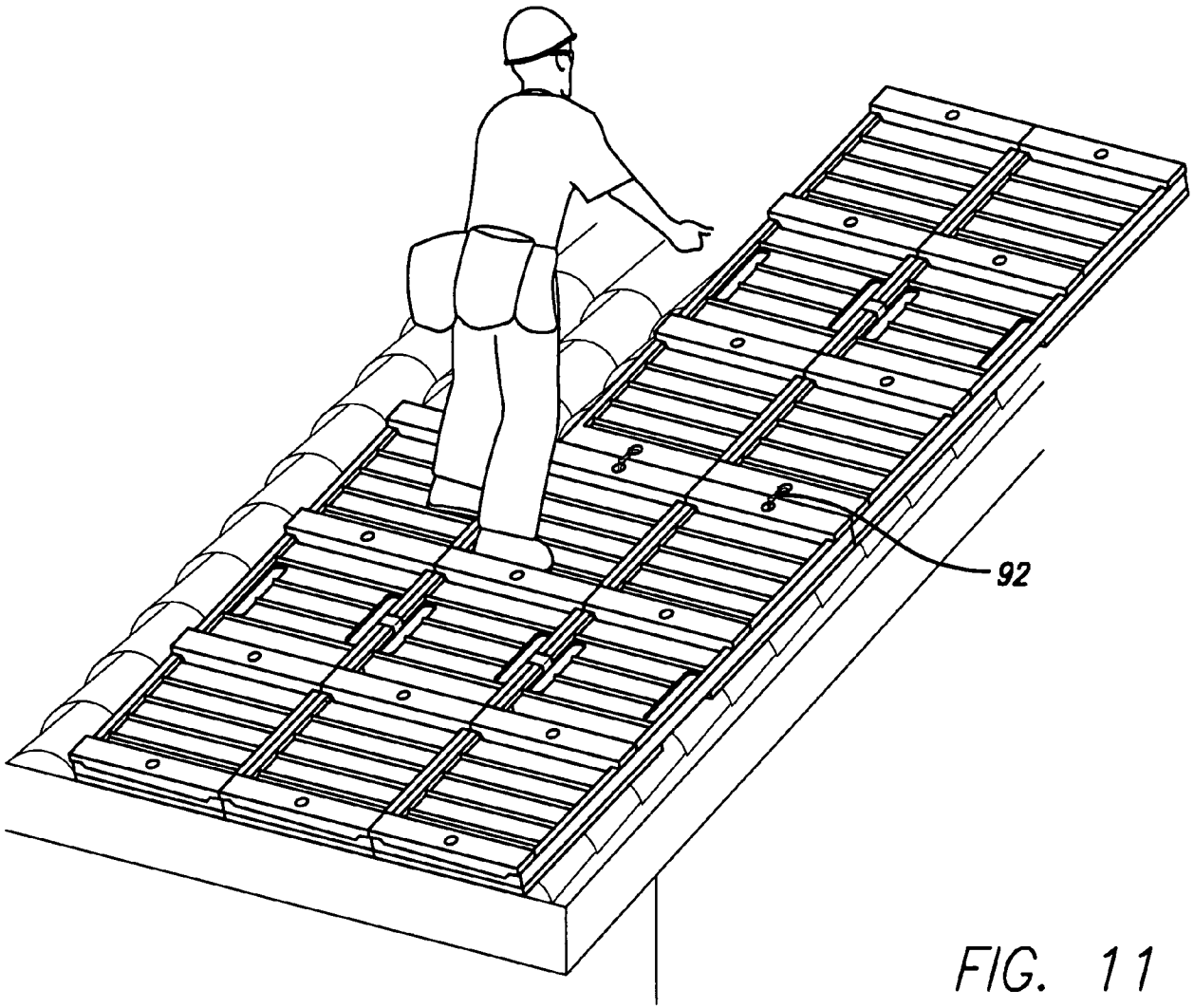
FIG. 11 is a perspective view of the support pad apparatus shown in use by a construction worker operating on an underlying sloped roof surface with riser members overlaying cross members in accordance with the present invention.
Figure 12:
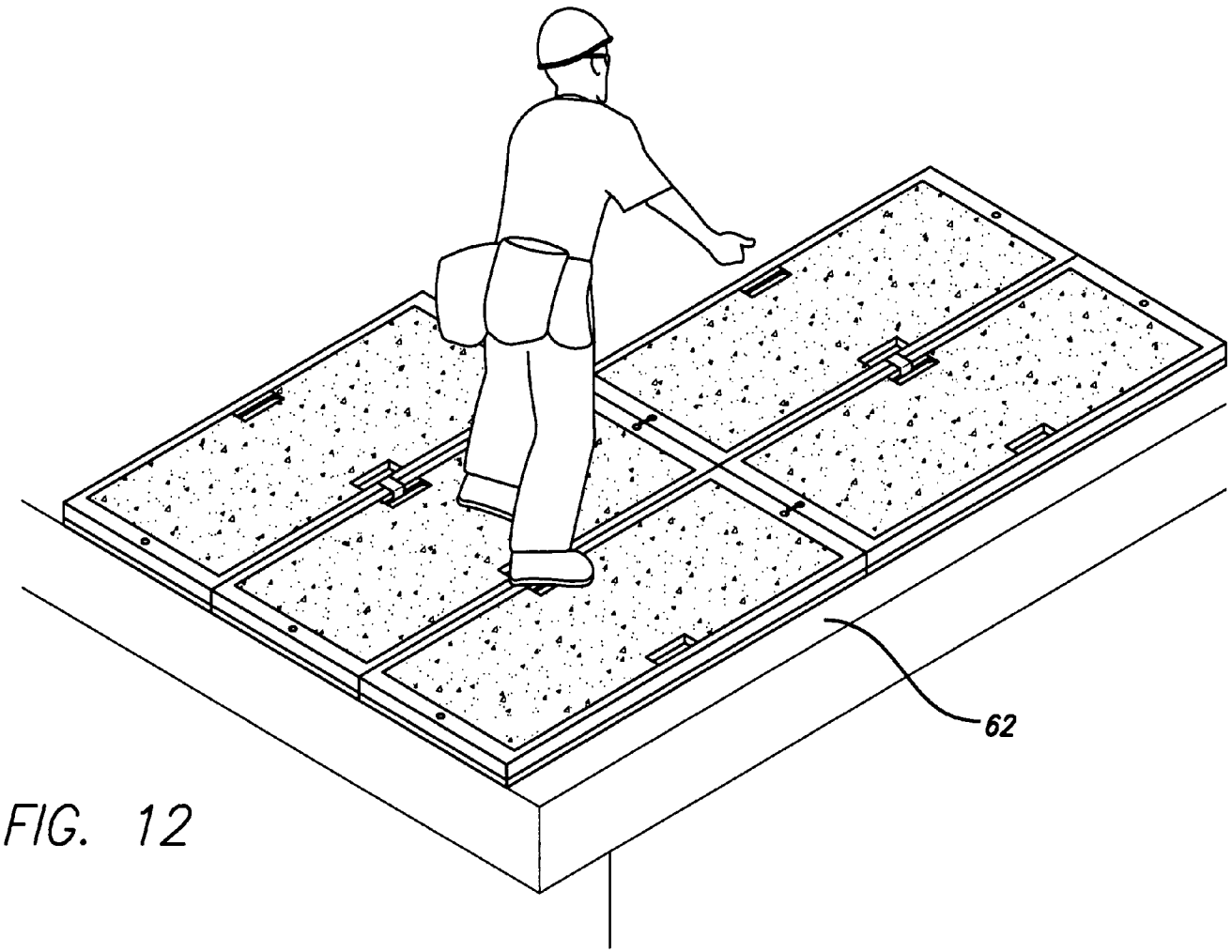
FIG. 12 is a perspective view of the support pad apparatus shown in use by a construction worker operating on an underlying generally level roof surface with the cover platform shown in FIG. 4A overlaying the base platform in accordance with the present invention.
Figure 13A:
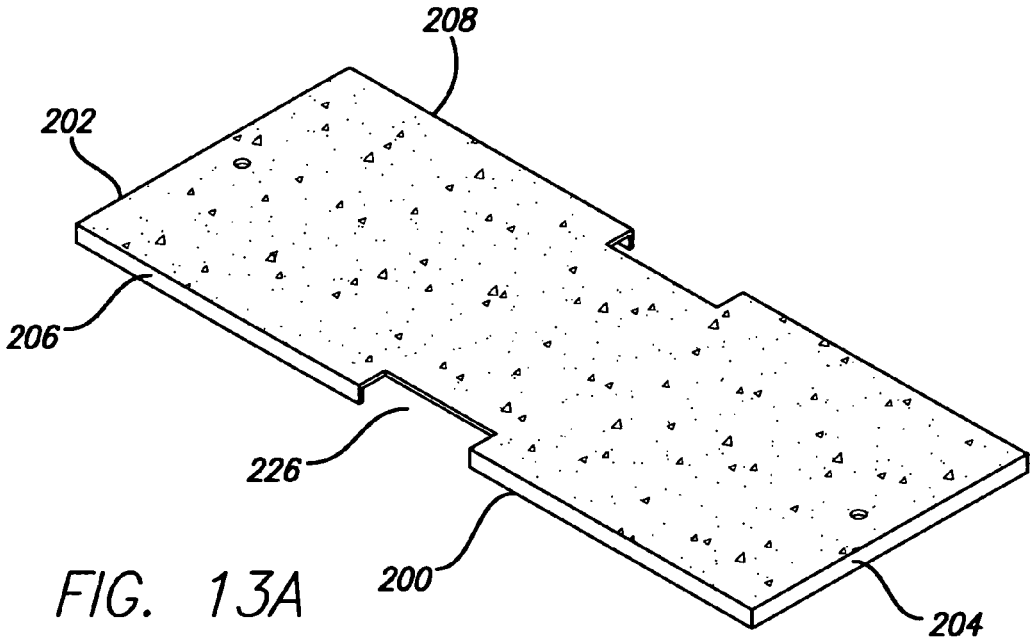
FIG. 13A is a perspective view of a second variant of the cover platform in accordance with the present invention.
Figure 13B:
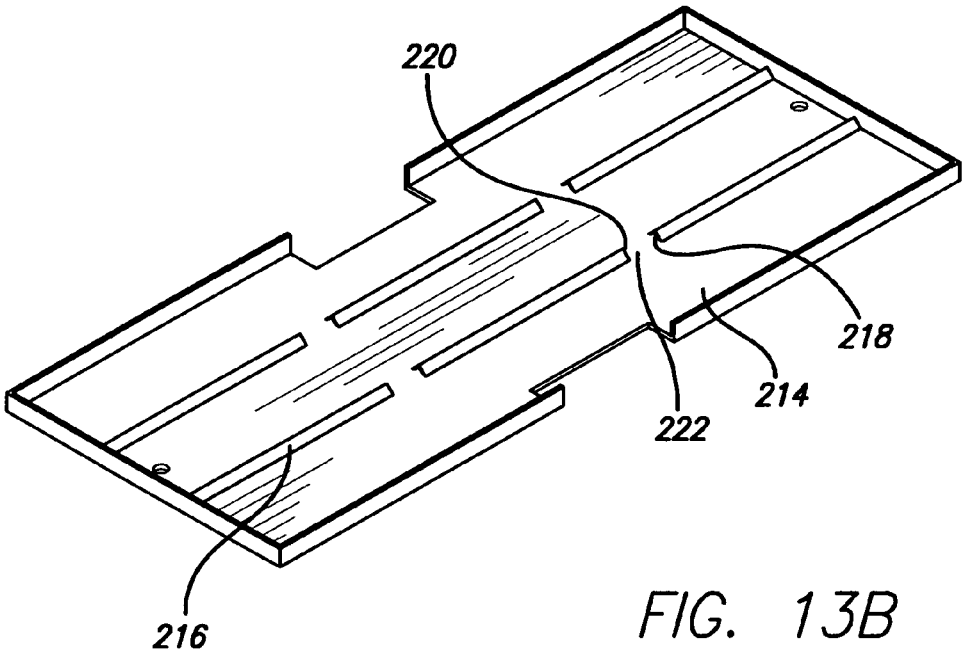
FIG. 13B is a perspective view of the bottom surface of the cover platform shown in FIG. 13A in accordance with the present invention.
Figure 13C:
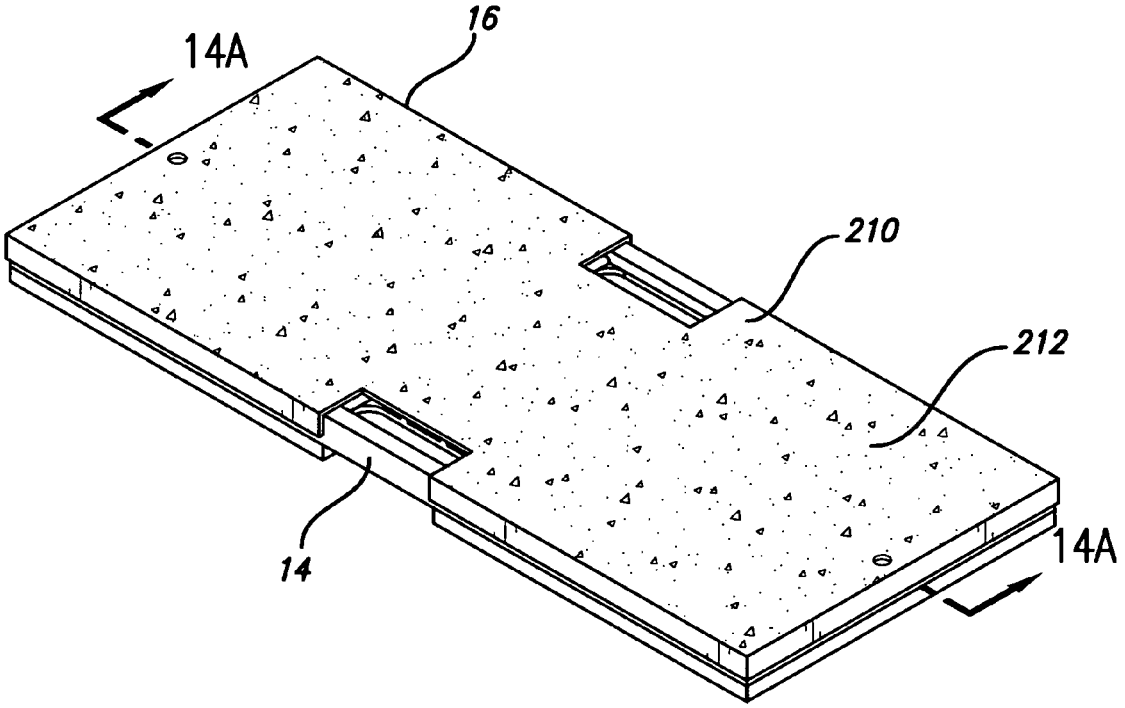
FIG. 13C is a perspective view of the cover platform shown in FIG. 13A overlaying the base platform in accordance with the present invention.
Figure 14A:
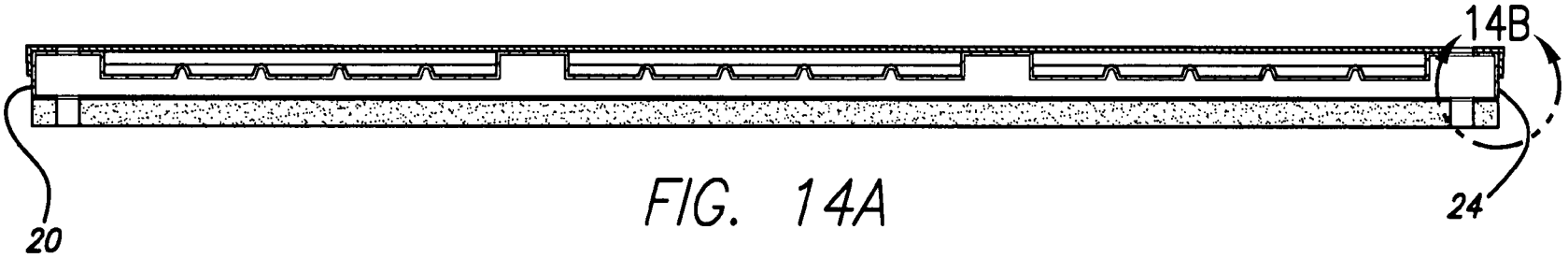
FIG. 14A is a cross-sectional view of the cover platform shown in FIG. 13A overlaying the base platform taken along lines 14A-14A of FIG. 13C in accordance with the present invention.
Figure 14B:
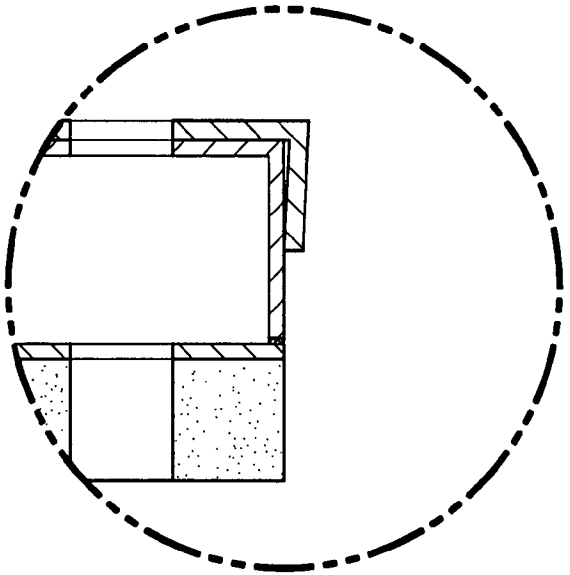
FIG. 14B is a view of an enlarged portion of the cross-sectional view of the cover platform shown in FIG. 14A defined by circular line 14B in FIG. 14A in accordance with the present invention.

Cover platform 60 is adapted for placement upon base platform 12 in overlaying relation, as shown in FIG. 4C, to convert base platform 12 for use on a variety of generally level surfaces, such as, for example only, flat roof surface 62 or upon an exterior hardscape (not shown). Cover platform 60 includes top surface 64 with an applied textured material 61, such as, for example, some type of paint with sand mixed in, or an embossed patterned surface (not shown), to provide better footing. Also provided are bottom surface 66, first side 68 and second side 70, front end 72, including front side 74, back end 76, which includes back side 78. Cover platform 60 includes an integrally formed surrounding down-turned rim 130, typically sloped slightly outwardly at an obtuse angle to form a secure friction fit. Cover platform 60 is formed from first side 68, second side 70, front side 74 and back side 78, with spaced sections 132 for accommodating cross members 32 when cover platform 60 is installed upon base platform 12 and placed into position. Slotted openings 75 are provided to join two or more platforms together or for transporting them to different locations. First side 68 is comprised of section members 134*a*,136*a*, which define an opening 138*a* and integrally formed elongated bearing member 140*a* to accommodate and support cleat members 30 positioned beneath. Section members 136*a*,142*a* define opening 144*a* for accommodating cross members 32 in conformal relation. Section members 146*a*,148*a* and 150*a* define opening 152*a* for forming the space for slotted opening 75. Second side 70 consists of respective counterparts from the opposite side of cover platform 60, including section members 134*b*,136*b*, 140*b*,142*b*,146*b*,148*b*, and 150*b*, and openings 138*b*,144*b* and 152*b*.

Bottom surface 66 includes a plurality of reinforcing support rib members 80 with spaced opposing ends 82,84 for providing greater overall strength and rigidity to cover platform 60. Support rib members 80 are disposed laterally and linearly in spaced relation to form slotted openings 86 between respective spaced ends 82,84 for receiving cross members 32 in each slotted opening 86 in conformal relation. When platform 60 overlays base platform 12, support rib members 80 are positioned transverse to the orientation of cleat members 30 and rest upon or are supported by cleat members 30 when the two platforms come together The joinder of these platforms, as described, further secured by the frictional fit made possible by the engagement of the slightly spread or sloped sides 68,70,74 and 78 against respective interior walls 14*a*,16*a*,20*a* and 24*a*, enables a more secure and stable union between base platform 12 and cover platform 60 to further enhance and ensure the rigidity of the combined support structure. Cover platform 60 may be comprised of any suitable material including, without limitation, synthetic resins and a variety of metal alloys, including steel and aluminum. Approximate dimensions of cover platform 60 are, as follows: 4' in length, 2' in width, 1¼" in height. These dimensions may vary depending upon several factors, including the dimensions of base platform 12.

Base platform 12, with or without projecting arms 230 and 232, includes openings 37 and 75 for receiving the means for securing two or more base platforms 12 together, including, for example, straps 90 and rope 92, and customized clips or ties made from any suitable natural or synthetic material (not shown).

Support rib members 80 are attached to bottom surface 66 utilizing means from the group of items comprised of spot welds 94, rivets, staples, screws and bolts (not shown), or a variety of other items suitable for this purpose. Support rib members 80 may also be pressed from the synthetic or metal alloy material employed to fabricate base platform 12 utilizing any suitable tool die for this purpose or alternatively fabricated by carving support rib members 80 directly from the same material employing any other suitable method to create an embossed or any other type of appropriate relief.

Support pad 10 may also include leveling insert 100, which overlays a group of cleat members 30 in the section of top surface 26 between any two cross members 32, and is disposed conformably therein with top surface 102 of insert 100 disposed generally at about the same height as top surface 33. Leveling insert 100 also includes bottom surface 104, which has a series of transverse ribs 106 for reinforcement. When leveling insert 100 is caused to overlay cleat members 30, as described, transverse ribs 106 rest upon cleat members 30 fitting conformably in the space situated beneath. Leveling insert 100 also includes first side 120, second side 122, front side 124 and back side 126, which are flared or bent slightly outward at an appropriately obtuse angle to enable leveling insert 100 to frictionally fit securely within the spaces between any two cross members 32 employing the same principle applied to secure the connection that cover platform 60 utilizes to secure itself within the framework of base platform 12. Approximate dimensions of leveling insert 100 are, as follows: 20" in length, 12" in width and 1" in height. These dimensions may vary depending upon several factors, including, without limitation, the dimensions of base platform 12. Leveling insert 100 may be comprised of a variety of materials including, but not limited to, synthetic resin and metal alloys, such as steel and aluminum.

An alternative to cover platform 60 is cover platform 200, which overlays base platform 12 in its entirety to enable front side 202, back side 204, first side 206 and second side 208, which are each bent slightly inward at an appropriately acute angle, to form a secure friction fit with front side 20, back side 24, first side 14 and second side 16, respectively. Typical dimensions of cover platform 200 are approximately 2' in width and 4' in length with a usual thickness of 1¼", although these dimensions may vary depending upon a variety of factors, including, without limitation, the dimensions of base platform 12.

As with cover platform 60, cover platform 200 is capable of use on a variety of surfaces, including, without limitation, generally flat roof surfaces 62 or exterior terrain (not shown). Cover platform 200 also includes a top surface 210, which may embody a textured material 212, such as, for example, some type of paint with sand mixed in, or an embossed patterned surface (not shown) to provide improved footing. Also provided is underside 214, which includes a plurality of reinforced support rib members 216 with spaced opposed ends 218,220 for providing greater strength and rigidity to cover platform 200. Two or more rib members 216 are disposed laterally and linearly in spaced relation to form slotted openings 222 between respective spaced opposed ends 218, 220 for receiving cross members 32 in conformal relation. As with cover member 60, when cover member 200 overlays base platform 12, support rib members 216 are positioned transverse to the orientation of cleat members 30 and made to rest upon and be supported by cleat members 30 when cover member 60 and platform 12 engage one another. The joinder of platform 12 to cover member 200, as described, further secured by the frictional fit made possible by engagement of the acutely sloped sidewalls 202 and 204 and sides 206 and 208 against respective sides 20, 24,14 and 16 of base platform 12, enables a more secure and stable union between base platform 12 and cover platform 200 to further enhance and secure the rigidity and strength of the combined support structure. Cover platform 200 may be comprised of any suitable material including, without limitation, synthetic resins and a variety of metal alloys, including steel and aluminum.

Cover platform 200 includes one or more slotted sections 226 for use, in concert with platform 12, in receiving the means for further securing base platform 12 and cover platform 200 to one another. Means for securing platforms 12 and 200 include, by way of example only, straps 90 and rope 92, and customized clips or ties made from any suitable material (not shown). Slotted openings 226 may also be used to hold platform 200 for maneuvering and transport.

Support rib members 216 are attached to underside 214 utilizing means from the group of items comprised of spot welds 94, rivets, staples, screws and bolts (not shown), or a variety of other items suitable for this purpose. Support rib members 216 may also be pressed from the synthetic or metal alloy material employed to fabricate cover platform 200 utilizing any suitable tool die for this purpose or alternatively fabricated by carving support rib members 216 from the same material using any other suitable method to create an embossed or any other type of relief.

Support pad 10 may also be combined with storage container 108, which may be attached using the frictional fit means described heretofore, or some other suitable means. Storage container 108 includes one or more dedicated compartments 110 for carrying or holding tools, construction materials and any other type of item typical of the construction trade. Integrally formed with or attached to storage container 108 are one or more openings 112, which can be used for securing container 108 to base platform 12, and one or more openings 113, which are used primarily for lifting or transporting storage container 108, but which may also be used as a means to secure container 108 to base platform 12 with the addition of rope 90, or strap 92, employed for this purpose. Storage container 108 also includes a continuous skirt portion 114 with a slight inward bend at an appropriately acute angle for frictionally seating container 108 conformably about sides 14,16,20 and 24 of base platform 12, in an overlaying fashion for securing one upon the other. A variant of container 108 includes either a single large contained space (not shown) or the same space with separate dividers (not shown), which may be installed for holding tools, or segregating tools and materials, as required. Approximate dimensions of storage container 108 are, as follows: length 4' "A", width 2' ⅜" and height 8". These dimensions may vary, however, due to a variety of factors, including, without limitation, the special size requirements of the user or the nature and type of equipment and/or materials intended to be contained within compartments 110. Storage container 108 may be comprised of a variety of materials including, without limitation, synthetic resins and metal alloys, such as steel and aluminum.

Need to Fix

This invention has been described in its presently preferred embodiment, and it is clear that it is susceptible to numerous modifications, modes and embodiments within the ability of those skilled in the art and without the exercise of this inventive faculty.

While the invention is in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

The invention claimed is:

1. A support pad apparatus for distribution of weight loads and enabling stable footing upon an underlying generally level or sloped surface, comprising:

a base platform, said base platform having a first side and a second side, a front end with a front side and a back end with a back side, a top surface and a bottom surface, and one or more cleat members attached to or integrally formed within said top surface and a plurality of rectangular shaped cross-members disposed in spaced relationship with said cleat members at opposite ends of said base platform and between said opposing cross-members across and formed integrally within or attached to said top surface, each of said cross-members having a first sidewall and a second sidewall with each said sidewall having a corresponding bottom portion extending the length of said sidewall, said cleat members and said cross-members being adapted to give support to a person's footing to compensate for any angle of inclination formed by said underlying surface and enabling the oblique orientation of said person's generally upstanding body relative to said sloped surface to ensure proper balance; and, a resilient pad attached to said bottom surface for substantially conforming to the shape and contours of said underlying surface, said resilient pad being joined to said base platform to give stability to said support pad apparatus disposed upon said underlying surface and to receive and distribute a weight load over said top surface to protect against damage to said underlying surface; and, further comprising a storage container sized to fit conformably over said top surface of said base platform, said storage container having at least one compartment with an opening at the top, a first end wall, a second end wall, a first sidewall and a second sidewall, each of said walls having an inwardly-bent integrally-formed skirt section adapted for frictionally seating said storage container upon said base platform.

2. The support pad apparatus of claim 1 wherein said storage container has one or more openings for use in attaching and securing said storage container to said base platform.

* * * * *